US006752395B2

(12) United States Patent
Jones et al.

(10) Patent No.: US 6,752,395 B2
(45) Date of Patent: Jun. 22, 2004

(54) METHOD OF PLAYING CARD GAMES

(75) Inventors: Daniel A. Jones, Las Vegas, NV (US); Albert J. Ethier, 10339 Scott Ave., Whittier, CA (US) 90603

(73) Assignee: Albert J. Ethier, Bellflower, CA (US)

( * ) Notice: Subject to any disclaimer, the term of this patent is extended or adjusted under 35 U.S.C. 154(b) by 0 days.

(21) Appl. No.: 10/349,905

(22) Filed: Jan. 23, 2003

(65) Prior Publication Data

US 2003/0168808 A1 Sep. 11, 2003

Related U.S. Application Data

(63) Continuation-in-part of application No. 10/059,550, filed on Jan. 29, 2002.

(51) Int. Cl.[7] ..... A63F 1/00
(52) U.S. Cl. ..... 273/292; 463/12; 463/13
(58) Field of Search ..... 273/292, 274, 273/309; 463/12, 13

(56) References Cited

U.S. PATENT DOCUMENTS 5,584,486 A 12/1996 Franklin
5,685,774 A * 11/1997 Webb ..... 463/13
2001/0045698 A1 * 11/2001 Lo ..... 273/292

* cited by examiner

*Primary Examiner*—Benjamin H. Layno

(74) *Attorney, Agent, or Firm*—Rob L. Phillips; Quirk & Tratos

(57) ABSTRACT

Methods of playing card games include the steps of (a) affording each player an opportunity to place an ANTE wager to participate in the game; (b) affording each player an opportunity to make an optional BONUS BET wager; (c) dealing three cards to each player and to a dealer; (d) affording each player an opportunity to view their cards; (e) affording each player an opportunity to either fold and forfeit their ANTE wager, or call by making a BET wager (f) evaluating whether the dealer's hand qualifies by achieving a predetermined point value; and (g) settling wagers by (1) if the dealer's hand does not qualify, paying the ANTE wagers and refunding the BET wagers to each remaining player and paying each remaining player who opted to make the BONUS BET wager an amount determined by a predetermined pay table based on a point value of the player's hand; (2) if the dealer's hand does qualify, comparing each remaining player's hand with the dealer's hand using point value as the criterion for comparison, (I) wherein if the dealer wins the hand the house wins the ANTE and BET wagers and pays to each remaining player who opted to make the BONUS BET wager an amount determined by a predetermined pay table based on the point value of the player's hand; and (II) wherein if a player wins the hand, the player wins the ANTE wager and is paid on the BET wager an amount according to a predetermined pay table based on the point value of the player's hand and the house pays to each remaining player who opted to make the BONUS BET wager an amount determined by a predetermined pay table based on the point value of the player's hand.

21 Claims, 2 Drawing Sheets

METHOD OF PLAYING CARD GAMES

This is a continuation-in-part of application No. 10/059,550, filed Jan. 29, 2002.

BACKGROUND OF THE INVENTION

1. Field of the Invention

The present invention relates to methods of playing card games, and more particularly pertains to variations of a conventional card game known as Rummy.

2. Description of the Related Technology

A variety of methods of playing card games, including methods of playing variations of Rummy, are reflected in the following U.S. Patents:

| U.S. Pat. No. | Inventor | Issue Date | Title |
|---|---|---|---|
| 5,374,067 | Jones | Dec. 20, 1994 | Method for playing a card game |
| 5,380,012 | Jones | Jan. 10, 1995 | Method for playing a card game |
| 5,810,361 | Kadlic | Sep. 22, 1998 | American canasta |
| 5,816,576 | Aramapakul | Oct. 6, 1998 | Method of playing a rummy-type card game |
| 5,853,325 | Kadlic | Dec. 29, 1998 | Method of playing an electronic rummy game apparatus |
| 6,027,119 | DeLisle | Feb. 22, 2000 | Method for playing a card game |

The entire disclosure of each of the foregoing patents is hereby incorporated herein by this reference.

SUMMARY OF THE INVENTION

Methods of playing live and electronic versions of card games according to example preferred embodiments of the invention include the steps of (a) affording each player an opportunity to place an ANTE wager to participate in the game; (b) affording each player an opportunity to make an optional BONUS BET wager; (c) dealing three cards to each player and to a dealer; (d) affording each player an opportunity to view their cards; (e) affording each player an opportunity to either fold and forfeit their ANTE wager, or call by making a BET wager; (f) evaluating whether the dealer's hand qualifies by achieving a predetermined point value; and (g) settling wagers by (1) if the dealer's hand does not qualify, paying the ANTE wagers and refunding the BET wagers to each remaining player and paying each remaining player who opted to make the BONUS BET wager an amount determined by a predetermined pay table based on a point value of the player's hand; (2) if the dealer's hand does qualify, comparing each remaining player's hand with the dealer's hand using point value as the criterion for comparison, (I) wherein if the dealer wins the hand the house wins the ANTE and BET wagers and pays to each remaining player who opted to make the BONUS BET wager an amount determined by a predetermined pay table based on the point value of the player's hand; and (II) wherein if a player wins the hand, the player wins the ANTE wager and is paid on the BET wager an amount according to a predetermined pay table based on the point value of the player's hand and the house pays to each remaining player who opted to make the BONUS BET wager an amount determined by a predetermined pay table based on the point value of the player's hand.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
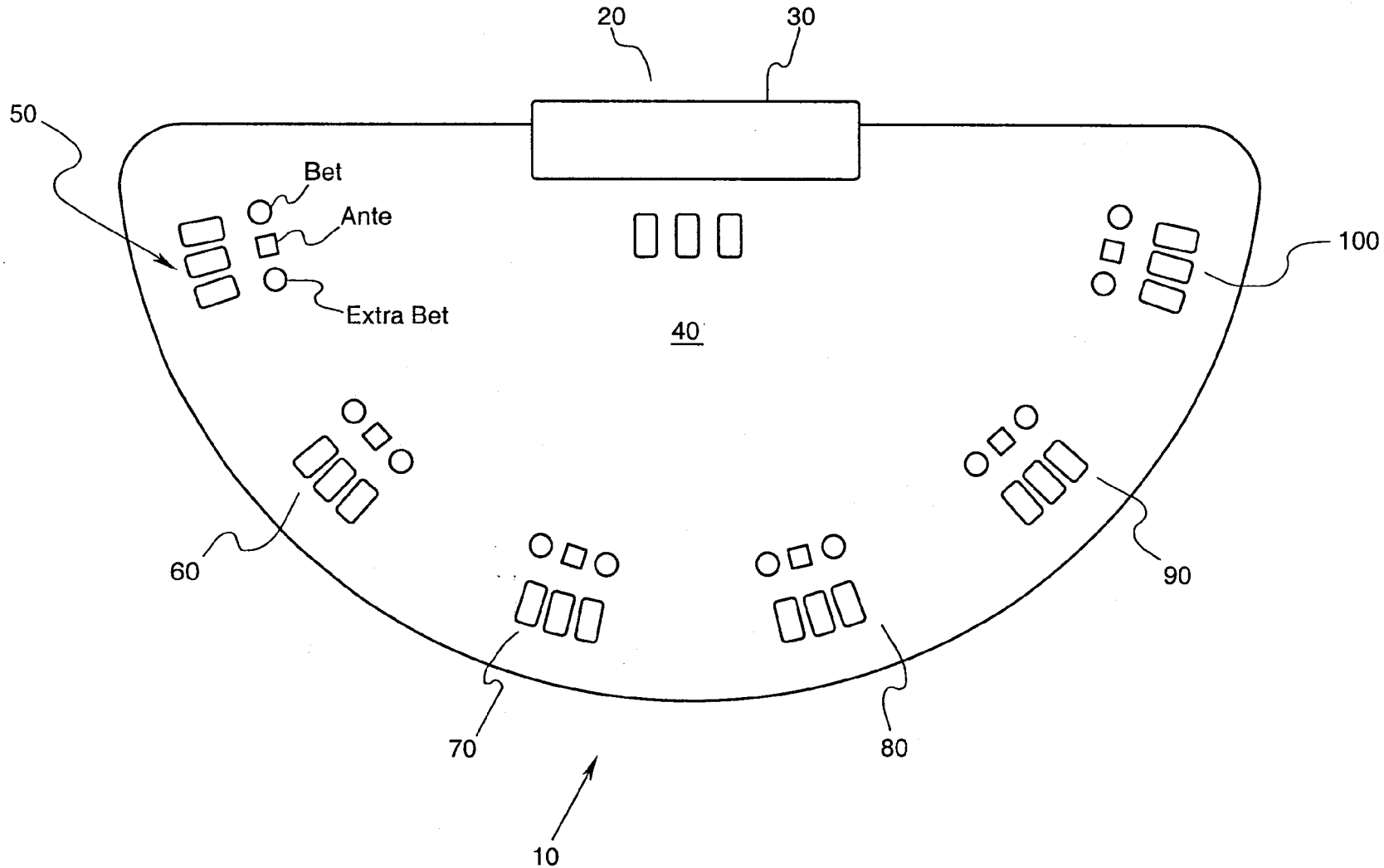
FIG. 2 is a plan view illustrating an example gaming table layout for use in playing a live casino version of a card game according to one embodiment of a method of the present invention.

Referring now to the drawings, and referring in particular to FIG. 2, one embodiment of a method of playing a card game according to the present invention may be implemented on a conventional type of casino gaming table layout 10 of the type used in casinos to play Twenty-One or Black Jack. Preferably, the table layout 10 includes a dealer position 20 adjacent to a chip rack 30, and six player positions 50, 60, 70, 80, 90, and 100 spaced around a curved perimeter of the layout 10, in a conventional manner.

As an alternative, the card game methods disclosed by the present invention may be implemented on an electronic gaming device of the type employed by casinos for playing electronic card game simulations, for example of draw poker, stud poker, Caribbean Stud™ Poker, etc. Other alternative ways of playing card games according to the methods of the present invention include software implementations on personal computers, either in stand alone modes, over local networks, or over the Internet. A still further implementation contemplates printing card representations on lottery cards and scratching away covering portions of the lottery card to reveal card hands. Accordingly, in conjunction with the instant application, the terms "cards," "dealing," "hand" and the like should be understood as encompassing both live card games with a human dealer and one or more players, as well as electronic games with electronic representations of cards displayed on a video screen. Similarly, the terms "wager," "bet," and "extra bet" should be understood as encompassing the use of currency, coins, chips, tokens, or electronic representations of value, in both live and electronic versions of implementation.

The game begins with one or more players placing an ANTE wager as a requirement for playing the game. In connection with a live version of the game, this can be accomplished, for example, by a player placing a conventional token or chip in an ANTE region designated on the felt surface 40 of the layout 10 of a conventional casino gaming table, as shown in connection with the player position 50, depicted in FIG. 2. In connection with an electronic version, a player may press an ANTE or WAGER button on an electronic gaming device, or may touch designated regions of a touch sensitive video screen.

Figure 1:
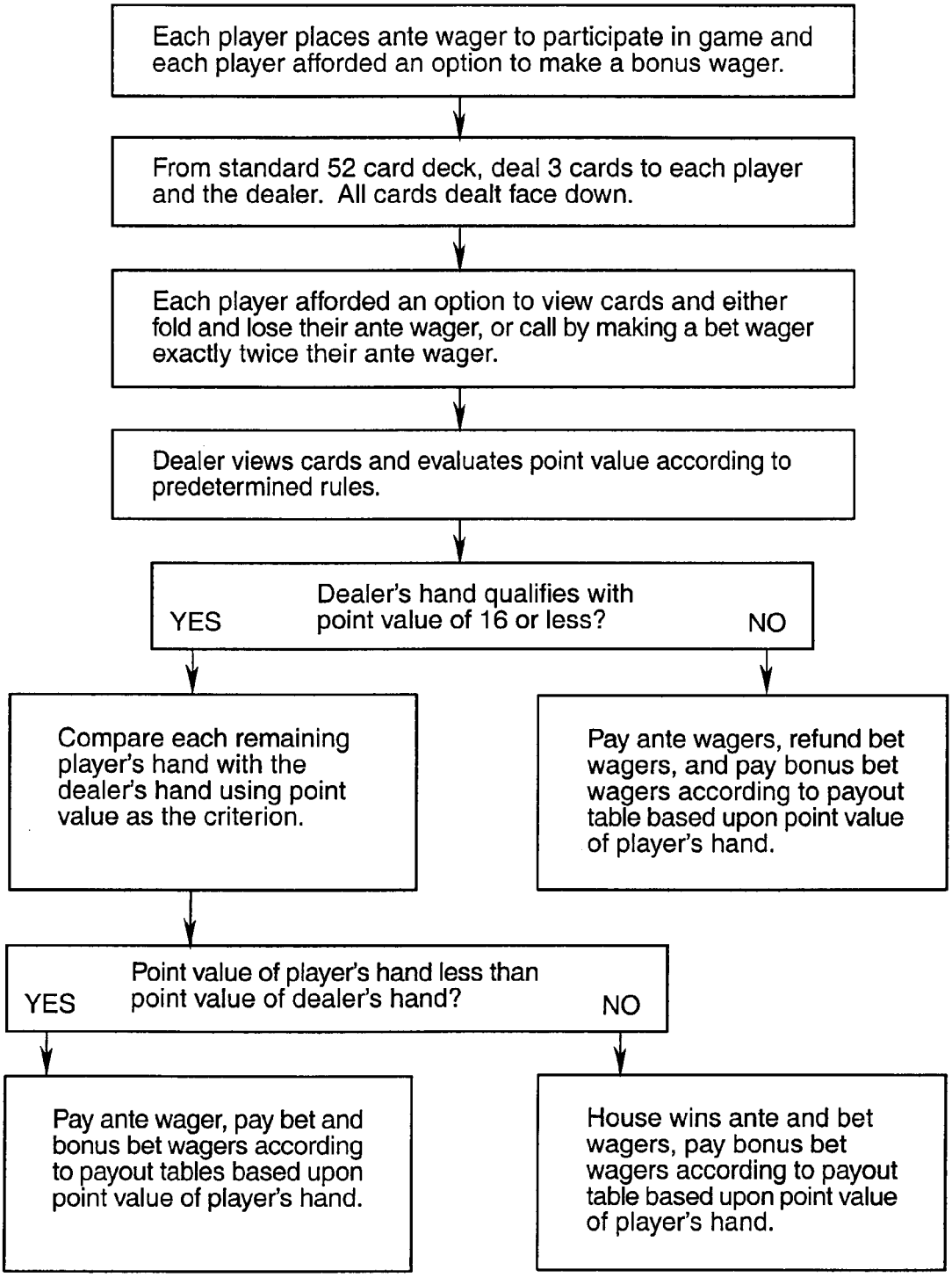
FIG. 1 is a flow chart illustrating a method of playing a card game according to one embodiment of the present invention.

With reference to the flow chart shown in FIG. 1, preferably after each of the players has placed the ANTE wager, each player is preferably afforded an opportunity to make an optional BONUS BET or wager. In a live casino version of the game, the BONUS BET wager may be made by a player positioning a token in a region disposed on a surface 40 of the layout 10 designated for the purpose, as shown adjacent player position 50 in FIG. 3. The sequence of placing the ANTE wager and the BONUS BET wager is preferably irrelevant. Thereafter, each player and the dealer are dealt three cards, face down, from a preferably shuffled standard 52-card deck of conventional playing cards. The use of a standard 52-card deck allows card hands to be dealt to each of six players and to one dealer. In connection with an electronic version of the game, the dealing involves displaying electronic representations of cards on a video screen, actuated, for example, by a player pressing a DEAL button on a video gaming device.

Players are then afforded an opportunity to view their three cards. After each player has been afforded an opportunity to view their cards, but before the dealer has been permitted an opportunity to inspect the dealer's cards, each player is preferably afforded an option to either FOLD and surrender their ANTE wager, or to continue play by placing a BET wager. In one embodiment of the invention, the BET wager must be exactly twice the amount of the ANTE wager. In connection with the live version of the game, a player may make the BET wager by placing an appropriate token or other indicator in a region of the gaming table layout 10 (FIG. 2) designated for the purpose, as shown adjacent the player position 50. In an electronic version of the game, a player may make a BET wager by pressing an associated button on an electronic gaming device, or by touching an appropriate region of a touch sensitive video screen.

The timing of the BET option being made prior to inspection of the dealer's cards prevents the dealer from either intentionally or inadvertently communicating information regarding the dealer's hand to the players.

After each player has been afforded the option to either FOLD or place a BET wager, the dealer views the dealer's three cards, and may at this time turn the cards face up on the surface 40 of the table layout 10, so that the players may also view the dealer's cards. In connection with the electronic version of the game, such viewing of the dealer's cards may be performed by a microprocessor operating under control of software or firmware and operative to reveal electronic card representations from a face down to a face up orientation, and to move such card representations to designated regions on a video screen for viewing by a game player.

Following viewing of the dealer's cards, the dealer's hand is evaluated according to predetermined criteria to ascertain whether the dealer's hand has "qualified." According to one preferred embodiment, the dealer's hand must qualify by achieving a point value below a, particular point value, preferably by achieving a point value of 16 or less.

If the dealer's hand does not achieve a point value of 16 or less, then the dealer or house must pay the ANTE wager, refund the BET wagers of each remaining player (each player that did not elect to FOLD), and pay the BONUS BET wagers according to a predetermined payout table based upon the point value of the player's hand. A preferred example Bonus Bet Payout Table appears as TABLE 2 below. Note that the preferred Bonus Bet Payout Table (TABLE 2) provides that only certain player hand point values win a payout on the BONUS BET, with the non-listed player hand point values resulting in the BONUS BET wager being won by the house. Thus, the BONUS BET can be viewed as a side bet between the player and the house as to whether the player's hand will have a predetermined winning point value as provided in the Bonus Bet Payout Table.

If the dealer's hand does qualify by achieving a point value of 16 or less, each remaining player's hand is compared with the dealer's hand using point value as the criterion for comparison. If the player's hand does not have a point value less than the point value of the dealer's hand, the house wins the ANTE and BET wagers and pays to each remaining player who opted to make the BONUS BET wager an amount determined by a predetermined pay table based on the point value of the player's hand. An example preferred Bonus Bet Payout Table appears as TABLE 2 below. If a player's hand has a point value less than the dealer's hand, the player wins the ANTE wager and is paid on the BET wager an amount according to a predetermined pay table based on the point value of the player's hand, and the house pays to each remaining player who opted to make the BONUS BET wager an amount determined by a predetermined pay table based on the point value of the player's hand. An example preferred Bet Payout Table appears as TABLE 1 below.

If the player's hand and the dealer's hand have the same point count, then the ANTE and the BET are a push, and are returned to the player, however, preferably the player is still paid for any BONUS BET wager according to the Bonus Bet Payout Table.

It should be understood that other payout tables or schedules for both the BET and BONUS BET wagers may be employed. Within the scope of the present invention, the terminology "predetermined payout table" should be understood as encompassing both fixed, randomly generated, and progressive payout amounts, as well as combinations of fixed, randomly generated, and progressive payout amounts. In addition to, in combination with, or as an alternative, the payouts may include electronic credits, gift vouchers, free or reduced entry into other contests, merchandise, services, etc.

In totaling or ranking the point values of the hands of players and the dealer, the following point values are preferably assigned:

Card Point Values

| Card | Point Value |
|---|---|
| Ace | 1 |
| King | 10 |
| Queen | 10 |
| Jack | 10 |
| 10 | 10 |
| 9 | 9 |
| 8 | 8 |
| 7 | 7 |
| 6 | 6 |
| 5 | 5 |
| 4 | 4 |
| 3 | 3 |
| 2 | 2 |
| Any Pair | 0 |
| Any Triple | 0 |
| Suited Run | 0 |

In connection with the instant specification and the appended claims, the term "Any Pair" is used in the conventional sense, such that a 9 of diamonds and a 9 of spades contained with the same hand would total 0 points. Similarly, the term "Any Triple" means any three cards of the same value, for example 9 of diamonds, 9 of spades, and 9 of clubs. The term "Suited Run" means any two or more consecutively ranked cards of the same suit (hearts, diamonds, clubs or spades). For example, Ace, 2, 3 suited;

or Ace, King suited, etc. The counting of Any Pair, Any Triple, and any Suited Run as a point value of 0 provides a "meld" type of feature which lends a familiar aspect of a conventional Rummy card game, so as to make the game more familiar, enjoyable, and readily accepted by players.

The following examples serve to further illustrate the preferred predetermined rules for evaluating the point value of player and dealer hands, as well as the qualification of the dealer hand.

EXAMPLE NO. 1

Dealer: King (spades), Ace (diamonds), 2 (clubs)=point value of 13, which qualifies.

Player: 4 (spades), 4 (hearts), 6 (clubs)=point value of 6 (as the pair of 4s count 0).

Player wins 1:1 on the ANTE wager and 2:1 on the BET wager for a total of 3 units or tokens.

If the player opted to make the BONUS BET wager, the player is paid 2:1 on the BONUS BET as well.

EXAMPLE NO. 2

Dealer: King (clubs), Queen (hearts), 6 (hearts)=point value of 26, no qualification.

Player: 9 (spades), 9 (hearts), 5 (clubs)=point value of 5 (as the paired 9s count 0).

The Player wins 1:1 on the ANTE wager, and the BET wager is refunded to the player with no payout. If the player opted to make the BONUS BET wager, the player is paid 2:1 on the BONUS BET as well.

EXAMPLE NO. 3

Dealer: 9 (hearts), 8 (hearts), 3 (clubs)=point value of 3 (as the suited 9–8 run counts 0). The dealer qualifies.

Player: King (spades), Queen (spades), 5 (diamonds)=point value of 5.

The Player loses the ANTE wager and loses the BET wager. If the player has made the BONUS BET wager, the player is paid 2:1 on the BONUS BET even though the hand was lost to the dealer.

TABLE 1 below reflects the payout ratio associated with particular point values of a player's hand for the BET wager, according to one example embodiment of the invention. For example, if a player's hand had a point value of 5 and met the conditions qualifying the player to win the BET wager, for example a $2 wager, then the player would be paid 2:1, or $4. Note that the payout table contains an exception to the foregoing rules when the player achieves a point count of 30. In such a situation, the player will never beat the dealer, however, the player is still awarded a payout of 10:1 on the BET wager.

TABLE 1

| | Bet Payout | | | |
|---|---|---|---|---|
| | Player Hand Point Value | | | |
| | 0 | 1–6 | 7–15 | 30 |
| Payout Ratio | 25:1 | 2:1 | 1:1 | 10:1 |

TABLE 2 below reflects the payout ratio associated with particular point values of a player's hand for the BONUS BET wager according to one example embodiment of the invention. For example, if a player's hand had a point value of 30 and met the conditions qualifying the player to win the BONUS BET wager, for example a $1 wager, then the player would be paid 40:1, or $40.

TABLE 2

| | Bonus Bet Payout | | | |
|---|---|---|---|---|
| | Player Hand Point Value | | | |
| | 0 | 1–6 | 7–15 | 30 |
| Payout Ratio | 50:1 | 2:1 | 1:1 | 40:1 |

TABLE 3 reports the results of a computer simulation using the indicated payout ratio for the various player hand point values.

TABLE 3

| Payout Statistics | | |
|---|---|---|
| Point Value | Percent Odds | Cumulative Percent |
| 0 | 0.0043 | 0.43% |
| 1 | 0.0211 | 2.54% |
| 2 | 0.0201 | 4.55% |
| 3 | 0.02 | 6.55% |
| 4 | 0.0198 | 8.53% |
| 5 | 0.0198 | 10.51% |
| 6 | 0.0217 | 12.68% |
| 7 | 0.0222 | 14.90% |
| 8 | 0.0242 | 17.32% |
| 9 | 0.0266 | 19.98% |
| 10 | 0.09 | 28.98% |
| 11 | 0.0124 | 30.22% |
| 12 | 0.0168 | 31.90% |
| 13 | 0.0269 | 34.59% |
| 14 | 0.0319 | 37.78% |
| 15 | 0.0411 | 41.89% |
| 16 | 0.0436 | 46.25% |
| 17 | 0.05 | 51.25% |
| 18 | 0.0515 | 56.40% |
| 19 | 0.0554 | 61.94% |
| 20 | 0.0553 | 67.47% |
| 21 | 0.0642 | 73.89% |
| 22 | 0.0553 | 79.22% |
| 23 | 0.0488 | 84.10% |
| 24 | 0.0388 | 87.98% |
| 25 | 0.0348 | 91.46% |
| 26 | 0.0259 | 94.05% |
| 27 | 0.0235 | 96.40% |
| 28 | 0.0151 | 97.91% |
| 29 | 0.0133 | 99.24% |
| 30 | 0.0076 | 100.00% |
| Total | 100.0000% | |

Based upon a computer simulation of ten million hands using the payouts reflected in TABLE 1 and TABLE 2 above, the basic game, without the BONUS BET option, provides a payback of 97.00%. When the BONUS BET option is added to the basic game, the payback is reduced to 96.62%.

The above tables illustrate particular calculated statistical payouts obtained in connection with particular preferred payout tables for the BET and BONUS BET wagers. Other alternative payout tables may be employed within the scope of the invention. Preferably, the BONUS BET wager may be paid independently of whether the dealer qualifies, and independently of whether the player's hand beats the dealer's hand. Alternatively, certain preconditions may be required for a player to win the BONUS BET wager. For example, the method of playing the game may require that the dealer qualify to make a player eligible to win the BONUS BET wager. Alternatively, the method of playing the game may require that the player's hand beats the dealer's hand in order to make a player eligible to win the BONUS BET wager. Also, the game may be played with the player having an option to place either the ANTE wager or the BONUS BET wager or both and may be played with the player required to place both wagers.

In a different variation of the foregoing described game, the following modifications are employed. The BET wager is equal to the amount of the ANTE wager. If a player's or a dealer's three cards contain both a two-card suited run and a pair, then the lowest point value is selected (e.g., if the three cards comprise a 2 (clubs), 2 (hearts), and 3 (hearts), the point value will be 2). The ace cannot be used to form the suited run (e.g., a three card hand comprising Queen (spades), King (spades), and Ace (spades) has a point value of 1). The dealer hand must qualify with a score of 20 or lower. When the dealer qualifies and a player wins, then the BET wager is paid odds according to the following pay table:

TABLE 4

| | Bet Payout Variation | | |
|---|---|---|---|
| | Player Hand Point Value | | |
| | 0 | 1–5 | 6–9 |
| Payout Ratio | 4:1 | 2:1 | 1:1 |

The bonus bet payout might also reflect different payout ratios, such as the following:

TABLE 5

| | Bonus Bet Payout Variations Pay Tables | | |
|---|---|---|---|
| Player Hand Point Value | Pay Table A | Pay Table B | Pay Table C |
| A-2-3 suited run | 100:1 | 100:1 | 100:1 |
| 0 | 25:1 | 20:1 | 22:1 |
| 1–6 | 2:1 | 2:1 | 2:1 |
| 7–10 | 1:1 | 1:1 | 1:1 |
| 11–12 | 4:1 | 4:1 | 3:1 |

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of playing a card game wherein at least one player competes against a dealer, comprising the steps of:

(a) providing at least one standard deck of playing cards;

(b) affording each player an opportunity to place an ante wager to participate in the game;

(c) dealing three cards to each player and to a dealer;

(d) affording each player an opportunity to view their cards and to either fold and forfeit their ante wager, or call by making a bet wager;

(e) only after steps (b)–(d), evaluating whether said dealer's hand qualifies according to predetermined qualifying criteria based upon a rummy-based point value of said dealer's hand;

(f) comparing said player hand against said dealer hand using a rummy-based point value as the criteria for comparison, wherein certain predetermined card combinations including any pair, any triple, and any two or more suited consecutive cards count as zero points; and (g) settling at least one of said ante and bet wagers according to at least one predetermined payout table.

2. The method of claim 1, further comprising the step of affording each player an opportunity to place an optional bonus bet wager.

3. The method of claim 2, wherein said bet wager is settled according to a first payout table and said bonus bet wager is settled according to a second, different payout table.

4. The method of claim 1, further comprising prior to step (c), the step of affording each player an opportunity to place an optional bonus bet wager.

5. The method of claim 4, wherein said bet wager is settled according to a first payout table and said bonus bet wager is settled according to a second, different payout table.

6. The method of claim 5, wherein step (f) is performed only if said dealer hand qualifies according to predetermined qualification criteria.

7. The method of claim 1, wherein step (f) is performed only if said dealer hand qualifies according to predetermined qualification criteria.

8. The method of claim 7, wherein said predetermined qualification criteria includes said dealer hand having a rummy-based point value of twenty or less.

9. The method of claim 1, wherein said bet wagers are settled substantially according to the following payout table based upon a rummy-based point value of said player's hand:

| | Player Hand Point Value | | |
|---|---|---|---|
| | 0 | 1–5 | 6–19 |
| Payout Ratio | 4:1 | 2:1 | 1:1 |

10. The method of claim 1, further comprising the step of affording each player an opportunity to place an optional bonus bet wager, and wherein said bonus bet wagers are settled substantially according to a payout table based substantially upon a rummy-based point value of said player's hand selected from the group of payout tables consisting of:

| Player Hand Point Value | Ace-2-3 | 0 | 1–6 | 7–10 | 11–12 |
|---|---|---|---|---|---|
| Payout Ratio | 100:1 | 25:1 | 2:1 | 1:1 | 4:1 |
| Payout Ratio | 100:1 | 20:1 | 2:1 | 1:1 | 4:1 |
| Payout Ratio | 100:1 | 22:1 | 2:1 | 1:1 | 3:1. |

11. The method of claim 1, wherein said game is played on a live casino gaming table with a human dealer.

12. The method of claim 1, wherein said game is played on an electronic gaming device.

13. A method of playing a card game, including the steps of:

(a) providing at least one standard deck of playing cards;

(b) affording each player an opportunity to place an ante wager to participate in the game;

(c) affording each player an opportunity to make an optional bonus bet wager;

(d) dealing three cards to each player and to a dealer;

(e) affording each player an opportunity to view their cards;

(f) affording each player an opportunity to either fold and forfeit their ante wager, or call by making a bet wager exactly twice the amount of the ante wager;

(g) after steps (b)–(f), evaluating whether the dealer's hand qualifies by achieving a predetermined rummy-based point value; and (h) settling wagers by (1) if the dealer's hand does not qualify, paying the ante wagers and refunding the bet wagers to each remaining player and paying each remaining player who opted to make the bonus wager an amount determined by a predetermined pay table based on a rummy-based point value of the player's hand; (2) if the dealer's hand does qualify, comparing each remaining player's hand with the dealer's hand using rummy-based point value as the criterion for comparison wherein any pair, any triple, and any two or more suited consecutive cards count as zero points;

(I) wherein if the dealer wins the hand the house wins the ante and bet wagers and pays to each remaining player who opted to make the bonus bet wager an amount determined by a predetermined pay table based on the rummy-based point value of the player's hand; and (II) wherein if a player wins the hand, the player wins the ante wager and is paid on the bet wager an amount according to a predetermined pay table based on the rummy-based point value of the player's hand and the house pays to each remaining player who opted to make the bonus bet wager an amount determined by a predetermined pay table based on the rummy-based point value of the player's hand.

14. The method of claim 13, wherein said bet wagers are settled substantially according to the following payout table based upon the rummy-based point value of said player's hand:

| | Player Hand Point Value | | |
|---|---|---|---|
| | 0 | 1–5 | 6–19 |
| Payout Ratio | 4:1 | 2:1 | 1:1 |

15. The method of claim 13, wherein said bonus bet wagers are settled substantially according to the following payout table based upon the rummy-based point value of said player's hand:

| Player Hand Point Value | Ace-2-3 suited run | 0 | 1–6 | 7–10 | 11–12 |
|---|---|---|---|---|---|
| Payout Ratio | 100:1 | 25:1 | 2:1 | 1:1 | 4:1 |
| Payout Ratio | 100:1 | 20:1 | 2:1 | 1:1 | 4:1 |
| Payout Ratio | 100:1 | 22:1 | 2:1 | 1:1 | 3:1. |

16. The method of claim 13, wherein said game is played on a live casino gaming table with a human dealer.

17. The method of claim 13, wherein said game is played on an electronic gaming device.

18. The method of claim 13, wherein said predetermined point value in step (f) is sixteen or less.

19. A method of playing a card game, including the steps of:

(a) providing at least one standard deck of playing cards;

(b) affording each player an opportunity to place an ante wager to participate in the game;

(c) affording each player an opportunity to make an optional bonus bet wager;

(d) dealing three cards to each player and to a dealer;

(e) affording each player an opportunity to view their cards;

(f) affording each player an opportunity to either fold and forfeit their ante wager, or call by making a bet wager exactly twice the amount of the ante wager;

(g) after steps of (b)–(f), evaluating whether the dealer's hand qualifies by achieving a predetermined point value of sixteen or less, wherein certain predetermined card combinations including any pair, any triple, and any two or more suited consecutive cards count as zero points;

(h) settling wagers by (1) if the dealer's hand does not qualify, paying the ante wagers and refunding the bet wagers to each remaining player and paying each remaining player who opted to make the bonus wager an amount determined by a predetermined pay table based on a rummy-based point value of the player's hand; (2) if the dealer's hand does qualify, comparing each remaining player's hand with the dealer's hand using a rummy-based point value as the criterion for comparison;

(I) wherein if the dealer wins the hand the house wins the ante and bet wagers and pays to each remaining player who opted to make the bonus bet wager an amount determined by a predetermined pay table based on the rummy-based point value of the player's hand; and (II) wherein if a player wins the hand, the player wins the ante wager and is paid on the bet wager an amount according to a predetermined pay table based on the rummy-based point value of the player's hand and the house pays to each remaining player who opted to make the bonus bet wager an amount determined by a predetermined pay table based on the rummy-based point value of the player's hand;

wherein said bet wagers are settled substantially according to the following payout table based upon the rummy-based point value of said player's hand:

| | Player Hand Point Value | | |
|---|---|---|---|
| | 0 | 1–5 | 6–19 |
| Payout Ratio | 4:1 | 2:1 | 1:1 |

wherein said bonus bet wagers are settled substantially according to the following payout table based upon the rummy-based point value of said player's hand:

| Player Hand Point Value | Ace-2-3 suited run | 0 | 1–6 | 7–10 | 11–12 |
|---|---|---|---|---|---|
| Payout Ratio | 100:1 | 25:1 | 2:1 | 1:1 | 4:1 |
| Payout Ratio | 100:1 | 20:1 | 2:1 | 1:1 | 4:1 |
| Payout Ratio | 100:1 | 22:1 | 2:1 | 1:1 | 3:1. |

20. The method of claim 19, wherein said game is played on a live casino gaming table with a human dealer.

21. The method of claim 19, wherein said game is played on an electronic gaming device.

* * * * *